US007785171B1

(12) United States Patent
Baker

(10) Patent No.: US 7,785,171 B1
(45) Date of Patent: Aug. 31, 2010

(54) TENSIONING DEVICE FOR CLOTHING STRAPS

(76) Inventor: Kathy L. Baker, 3431 W. Greenview Ter., Pompano Beach, FL (US) 33063

( * ) Notice: Subject to any disclaimer, the term of this patent is extended or adjusted under 35 U.S.C. 154(b) by 306 days.

(21) Appl. No.: 10/817,394

(22) Filed: Apr. 2, 2004

Related U.S. Application Data

(60) Provisional application No. 60/547,633, filed on Feb. 25, 2004.

(51) Int. Cl.
*A41C 3/00* (2006.01)

(52) U.S. Cl. ..... 450/86; 2/338

(58) Field of Classification Search ..... 450/86–89; 2/300, 304, 305, 310–330, 336, 338, 155, 2/156–157, 920; 24/199, 312, 313, 310
See application file for complete search history.

(56) References Cited

U.S. PATENT DOCUMENTS 1,401,227 A * 12/1921 Wyeth ..... 2/323
1,410,306 A * 3/1922 Hoffmann et al. ..... 24/300
1,478,773 A * 12/1923 Stocker ..... 2/323
1,648,776 A * 11/1927 McOrin ..... 2/323
2,884,647 A * 5/1959 Cuttler ..... 2/321
3,086,529 A * 4/1963 Munz et al. ..... 606/203
3,440,667 A * 4/1969 Dye ..... 2/325
4,384,583 A * 5/1983 Speelman et al. ..... 606/203
4,612,935 A * 9/1986 Greifer ..... 450/86
4,858,249 A * 8/1989 Stewart ..... 2/305
6,006,364 A * 12/1999 Newsom et al. ..... 2/323
6,081,925 A * 7/2000 Reiber ..... 2/125
6,135,853 A * 10/2000 Hopson ..... 450/86

* cited by examiner

*Primary Examiner*—Gloria Hale
(74) *Attorney, Agent, or Firm*—Joseph R. Englander; Shutts & Bowen LLP

(57) ABSTRACT

A clothing strap tensioning device has an elastic member having a geometry generally defined by middle, left end, and right end portions, and bounded by upper, lower, left and right edges, and includes mechanical snaps or other releasable attachment mechanisms integrated into the left end and right end portions for enabling releasable attachment of the end portions to each other to form the elastic member into a loop. The tensioning device is looped around a pair of spaced vertical straps of a brassiere, such that the straps are drawn toward each other medially to prevent the straps from slipping down the shoulders of a wearer and to impart an upward lift to the wearer's breasts. The geometry of the elastic member also prevents twisting of the straps.

9 Claims, 3 Drawing Sheets

TENSIONING DEVICE FOR CLOTHING STRAPS

CROSS REFERENCE TO RELATED APPLICATION

This application relates to the same subject matter as co-pending provisional patent application Ser. No. 60/547,633, filed by the same applicant on Feb. 25, 2004. This application claims the Feb. 25, 2004 filing date as to the common subject matter.

BACKGROUND OF THE INVENTION

1. Field of the Invention

The present invention relates generally to a clothing accessory, and more particularly, to a tensioning device that draws clothing straps, such as brassiere straps, together to keep them from inadvertently slipping down over the wearer's shoulders and, in the case of brassiere straps, imparts an upward lift to the brassiere cups.

2. Description of the Prior Art

Clothing having straps, such as tank tops and brassieres that provide women support, are well known in the art. Although common, conventional straps can be uncomfortable and unreliable in providing support. Comfort and reliability are typically compromised when the straps inadvertently slip down or off the shoulders. Straps often slip down the shoulders when they lose tension due to stretching and loosening of the elastic straps over time, affecting the comfort, appearance and support of the brassiere or garment. Furthermore, with regard to brassieres, women are constantly searching for products such as push-up type brassieres, which, in addition to providing the usual support, offer enhanced upward lift to the breasts via the brassiere cups.

If a device existed that could prevent and/or limit inadvertent movement and slipping of straps by maintaining tension in the straps it would be well received. Furthermore, it would be desirable to provide such a device that, in addition to preventing such slipping of the straps, provided enhanced upward lift to the brassiere cups in order to impart corresponding upward lift to the wearer's breasts. The present invention addresses these unfulfilled needs in the prior art by providing an accessory that maintains tension in clothing straps, even after they have lost some degree of elasticity, preventing them from slipping, and providing the aforementioned enhanced upward lift.

SUMMARY OF THE INVENTION

The present invention is generally directed to a clothing strap tensioning device configured to draw a pair of vertically disposed clothing straps toward each other in a manner increasing the tension of the straps. By way of the improved tensioning, the device prevents the problems of straps slipping off of the shoulders of the wearer, even after the strap elasticity has been degraded. In the case of brassieres, the device provides increased tensioning sufficient to enhance lift provided by the brassiere cups.

In a first general embodiment of the invention, the tensioning device comprises:

an elastic member having a geometry generally defined by middle, left end, and right end portions, and bounded by upper, lower, left and right edges; and means integrated into the left end and right end portions for enabling releasable attachment of the end portions to each other to form the elastic member into a loop, wherein, upon securing the tensioning device about the spaced-apart clothing straps, the clothing straps are drawn inwardly toward each other medially in a manner preventing twisting of the straps.

In another aspect of the invention, the releasable attachment means integrated into the left end and right end portions are configured to enable adjustment to the tension of said device.

In another aspect of the invention, the releasable attachment means is comprised of a plurality of spaced-apart mechanical snaps integrated into either the left or right end portion of the elastic member, for snap fit engagement with a corresponding snap member integrated into the other one of the left and right end portions.

In another aspect of the invention, the releasable attachment means comprises one-half of a hook-and-loop type fastening system integrated into the left end portion of the elastic member and the other half of the hook-and-loop type fastening system integrated into the right end portion.

In another aspect of the invention, the elastic member is characterized by left and right end portions projecting in an upward direction distally from the middle portion.

In another aspect of the invention, the elastic member is characterized by a varying transverse width, the transverse width defined as the transverse distance between the upper and lower edges at any point along the length of the elastic member.

In another aspect of the invention, the transverse width is substantially uniform along the middle region of said elastic member and increases along the left and right portions distally from the middle portion.

In another aspect of the invention, the elastic member is characterized by a geometry in which the upper and/or lower edges slope upwardly from the middle portion of the elastic member toward the left and right end portions thereof.

In a second general embodiment of the invention, the tensioning device comprises:

a first elastic member directly fastened to a first one of the clothing straps;

a second elastic member directly fastened to a second one of the clothing straps; and means integrated into the first and second elastic members for enabling releasable attachment of the elastic members to each other, wherein, upon fastening the first and second elastic members to each other the vertically disposed clothing straps are drawn toward each other medially.

In another aspect of the invention, the first elastic member has a portion fastened to the first one of the clothing straps and an unfastened flap portion extending therefrom, and the second elastic member has a portion fastened to the second one of said clothing straps and an unfastened flap portion extending therefrom.

In another aspect of the invention, the releasable attachment means is comprised of at least one snap member integrated into the unfastened flap portion of the first one of the clothing straps, and at least one mating snap member integrated into the unfastened free portion of the second one of said clothing straps.

In another aspect of the invention, the releasable attachment means is comprised of one half of a hook-and-loop, or hook-and-pile, type fastening system integrated into the unfastened flap portion of the first one of said clothing straps, and the other half of the hook-and-loop fastening system integrated into the unfastened flap portion of the second one of said clothing straps.

In a third general embodiment of the invention, the tensioning device has a unitary, or one-piece, construction comprising:

a planar rear wall portion;

left and right planar front wall portions disposed in a common plane and parallel to the rear wall portion; and a pair of side wall portions adjoining the respective left and right front wall portions to opposite ends of the rear wall portion;

the left and right front wall portions terminating at respective edges defining a strap-receiving opening therebetween; and, the rear, front and side wall portions together defining a strap retaining slot sized and shaped for simultaneously retaining said pair of clothing straps in a tensioned condition while preventing twisting of said straps.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention is generally directed to clothing strap tensioning devices particularly configured for engaging a pair of spaced-apart vertically disposed clothing straps, and particularly brassiere straps, such that the straps are drawn toward each other medially. The tensioning devices function to prevent the inadvertent slipping of the straps down over the shoulders. Furthermore, when applied to brassiere straps, the tensioning devices further function to impart an upward lift to brassiere cups attached to the straps.

Figure 1:
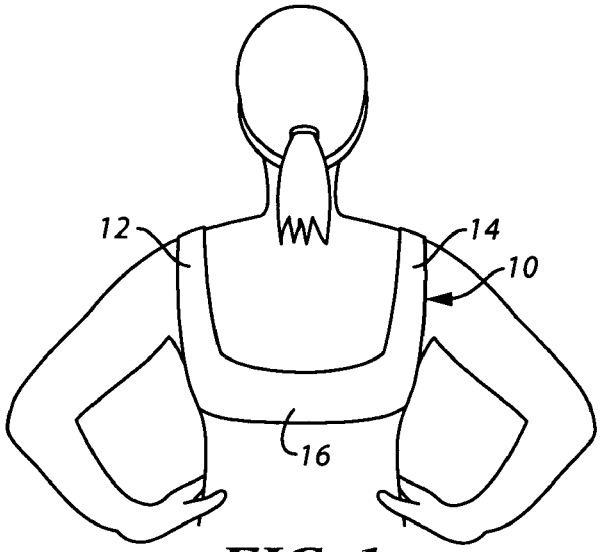
FIG. 1 (Prior Art)
FIG. 1 is a rear view of a conventional brassiere, donned by a woman, in accordance with the prior art.
Figure 2:
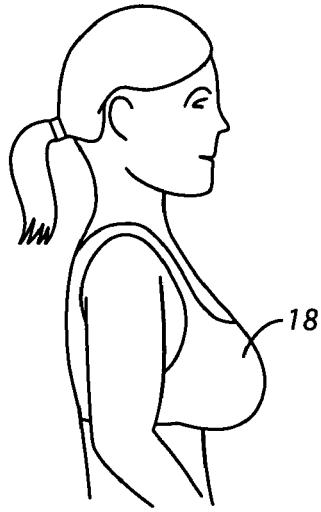
FIG. 2 (Prior Art)
FIG. 2 is a side view of a woman donning the conventional brassiere shown in FIG. 1, illustrating the limited brassiere cup support provided by the brassiere straps.

Referring initially to FIGS. 1 and 2, a conventional brassiere in accordance with the prior art, shown generally as reference numeral 10, includes a pair of spaced-apart vertically oriented straps 12, 14 each adjoined at one end adjacent to the back of a wearer by a horizontally oriented portion 16, and terminating at an opposite end adjacent the front of the wearer at a cup portion 18. As best illustrated in FIG. 2, this conventional prior art brassiere structure provides only limited support to the breasts of the wearer. Over time, as the elasticity of the straps 12, 14 is reduced, support is even further diminished. Furthermore, the resulting reduced tension in the straps commonly leads to slipping of the straps down the shoulders of the wearer.

Figure 3:
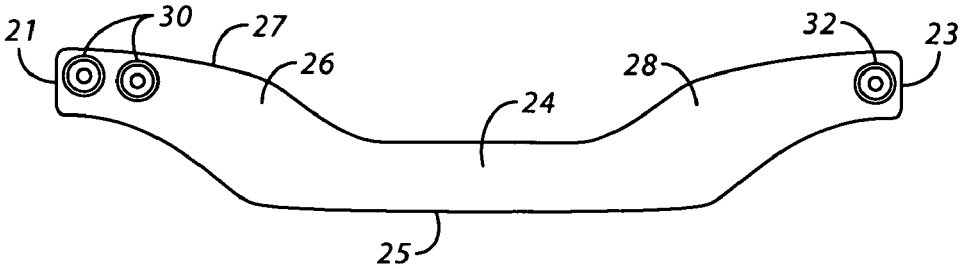
FIG. 3 is a rear elevation view of a clothing strap tensioning device in accordance with a preferred embodiment of the invention, shown in a non-stretched fully extended condition, illustrating a preferred geometry of the elastic body.
Figure 4:
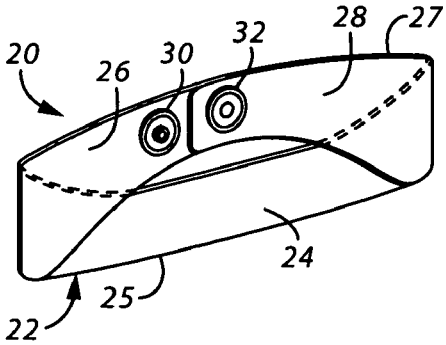
FIG. 4 is a rear elevation view of the clothing strap tensioning device of FIG. 3, shown in a closed position.
Figure 5:
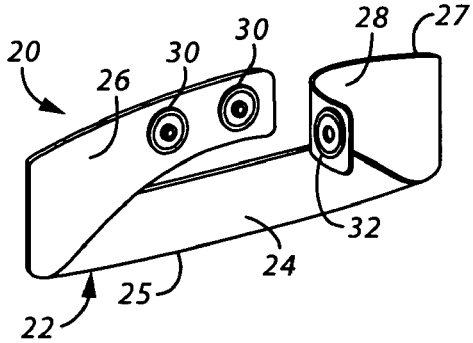
FIG. 5 is a rear elevation view of the clothing strap tensioning device of FIG. 3, shown in an opened position.

Referring now to FIGS. 3-5, a tensioning device 20 is shown in accordance with a first general embodiment of the present invention. The tensioning device 20 includes a generally elongated elastic member 22, preferably having a symmetric geometry to impart substantially equal tension to each strap, and comprising a middle portion 24 adjoining a left end portion 26 and a right end portion 28. The elastic member has a shape defined by left edge 21, right edge 23, lower edge 25 and upper edge 27. A variety of elastic member 22 geometries are contemplated, including a generally rectangular-shaped elastic member. However, for reasons that will become apparent, the general geometry illustrated in FIG. 3 is preferred. In particular, it is preferred that the elastic member 22 have a geometry wherein the left and right end portions 26, 28 of the elastic member project upwardly in a direction away from the middle portion. Furthermore, it is preferred that the elastic member 22 has an increased transverse width along corresponding segments of the left and right end portions, 26 and 28, adjacent to the middle portion 24. As used herein, the term "transverse width" is intended to define the distance between points on the lower and upper edges, 25 and 27, along any vertical section through member 22.

Fastening means are provided for enabling releasable attachment of the left- and right-end portions, 26 and 28, to each other to form a continuous loop, or band, about the straps 12, 14, as illustrated in FIG. 4. As shown in FIGS. 3-5, in one aspect of the invention releasable attachment is achieved using conventional mechanical snaps 30, 32. Preferably a single snap 32 is integrated into one of the end portions (in this case right end portion 28), and a plurality of mating snaps 30 are provided integrated into the other end portion (in this case left end portion 26) in spaced-apart relationship, enabling the user to vary the degree of tension imparted by the tensioning device 20 to the straps 12, 14. As will be apparent to those skilled in the art, various alternate means of attachment are possible. For example, releasable attachment may be achieved by integrating one half of a hook-and-loop, or hook-and-pile, type fastening system (not shown) into the left end portion 26 of the elastic member 22, and integrating the other half of the hook-and-loop type fastening system into the right end portion 28. Metallic and plastic snap-fits, clasps, magnets, buttons and any other known releasable attachment mechanisms that can be employed to enable tension adjustment are also contemplated. Furthermore, tension adjustment can be accomplished by incorporating a conventional slide component through which the elastic member 22 extends and which cooperates with the elastic member to enable length adjustment thereof.

Figure 6:
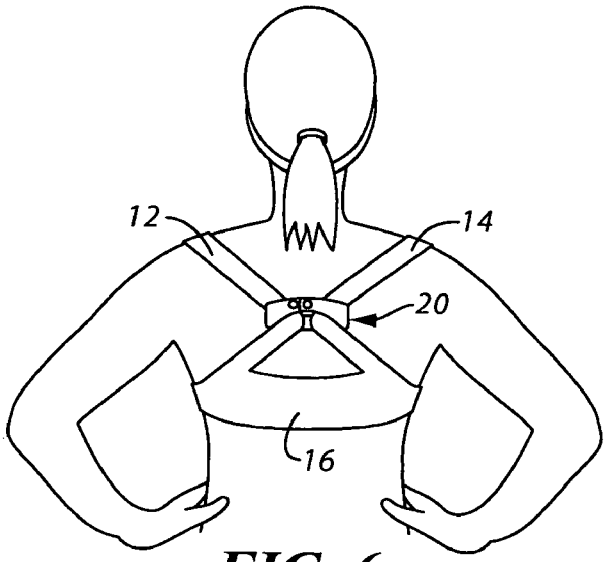
FIG. 6 is a rear view of a conventional brassiere, donned by a woman, and incorporating the preferred tensioning device in FIGS. 3-5.
Figure 7:
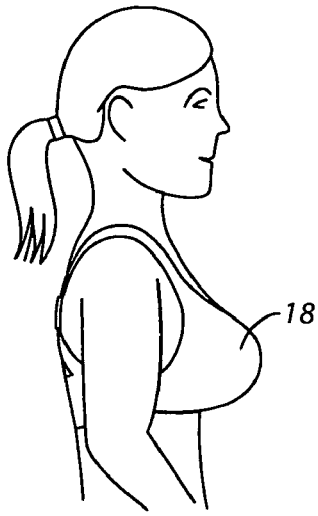
FIG. 7 a side view of a woman donning the conventional brassiere incorporating a tensioning device in accordance with the present invention, illustrating the resulting improved lift to the brassiere cups provided by the tensioned brassiere straps.

Referring now to FIGS. 3-6, and particularly to FIG. 6, when the elastic member is engaged around the straps 12, 14 and closed, the middle portion of the elastic member is positioned adjacent to the wearer's back and engages the inner surface of the straps 12, 14 while the left- and right-end portions, 26 and 28, of the elastic member 22 are positioned along and, at least partially engage the outer surface of the straps. As shown in FIGS. 1, 2, 6, and 7, the straps are shoulder straps on a garment which extend to the rear of the garment. Accordingly, the portions of the elastic member 22 having the increased transverse width are positioned adjacent to, and frictionally engage, the outer edges of the straps. The engagement of the aforementioned wider portions of the member 22 with the outer edges of the straps 12, 14 functions to stabilize the straps in order to reduce the occurrence of strap twisting. As further shown in FIG. 6, each of the left- and right-end portions 26 and 28 of the elastic member 22 project upwardly and perpendicularly away from the middle portion of the elastic member, and wherein, upon securing the tensioning device about the rear shoulder straps, the rear shoulder straps are drawn inwardly. As best shown in FIG. 7, upon application of the tensioning device 20 to a conventional brassiere, the increased tension to the straps acts to impart an upward lift to the brassiere cups, providing the desired pushing up of the breasts desired by women.

Figure 8:
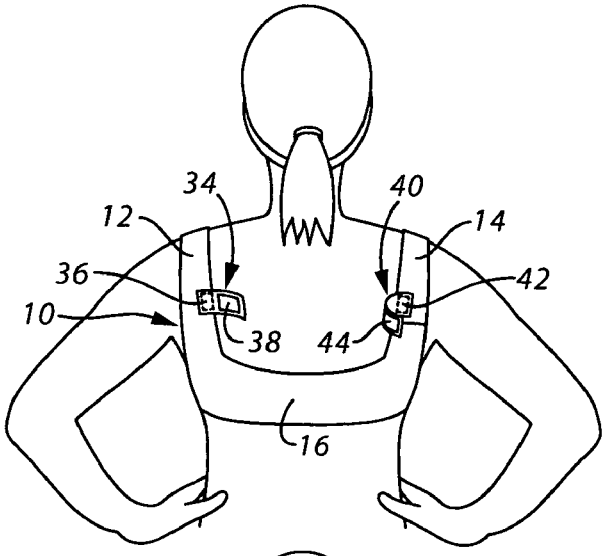
FIG. 8 is a rear view of a conventional brassiere, donned by a woman, and incorporating a two-piece elastic tensioning mechanism integrated directly into the straps, in accordance with a second embodiment of the present invention.
Figure 9:
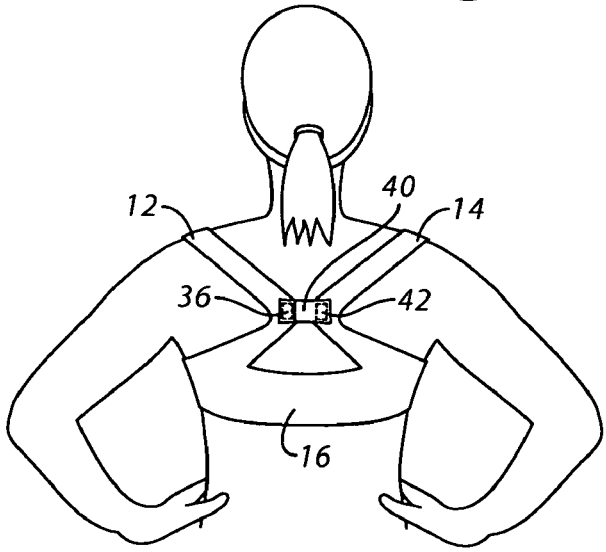
FIG. 9 is a rear view of the donned conventional brassiere of FIG. 8, with the integral tensioning mechanism employed.

Referring now to FIGS. 8-9, a tensioning mechanism is shown in accordance with a second general embodiment of the present invention. The tensioning mechanism includes a first elastic member 34 having a portion 36 permanently stitched, or otherwise secured, to the left brassiere strap 12, and a second elastic member 40 having a portion 42 secured in a similar fashion to the right brassiere strap 14. Attachment means 38, 44 are preferably integrated into the non-stitched flap portions of the elastic members to enable and facilitate releasable attachment of the elastic members 34, 40 to each other such that the vertically oriented straps 12, 14 of the brassiere are drawn toward each other to impart tension to the straps, and corresponding upward lift to the brassiere cups.

As best shown in FIG. 8, the preferred means of attachment is by a hook-and-loop type fastening system. In particular, one half of a hook-and-loop, or hook-and-pile, type fastening system 38 is integrated into the left elastic member 34 attached to the left vertical strap 12, and the other half of the hook-and-loop type fastening system 44 is integrated into the right elastic member 40 attached to the right vertical strap 14. In this manner, the degree of tension imparted to the straps can be varied by adjusting the degree of overlap of the elastic members 34, 40 during attachment. As will be apparent to those skilled in the art, various alternate means of attachment are possible. For example, releasable attachment may be achieved by conventional mechanical snaps, metallic and plastic snap-fit assemblies, clasps, magnets, buttons and any other known releasable attachment mechanisms that can be employed to enable tension adjustment by the wearer.

Figure 10:
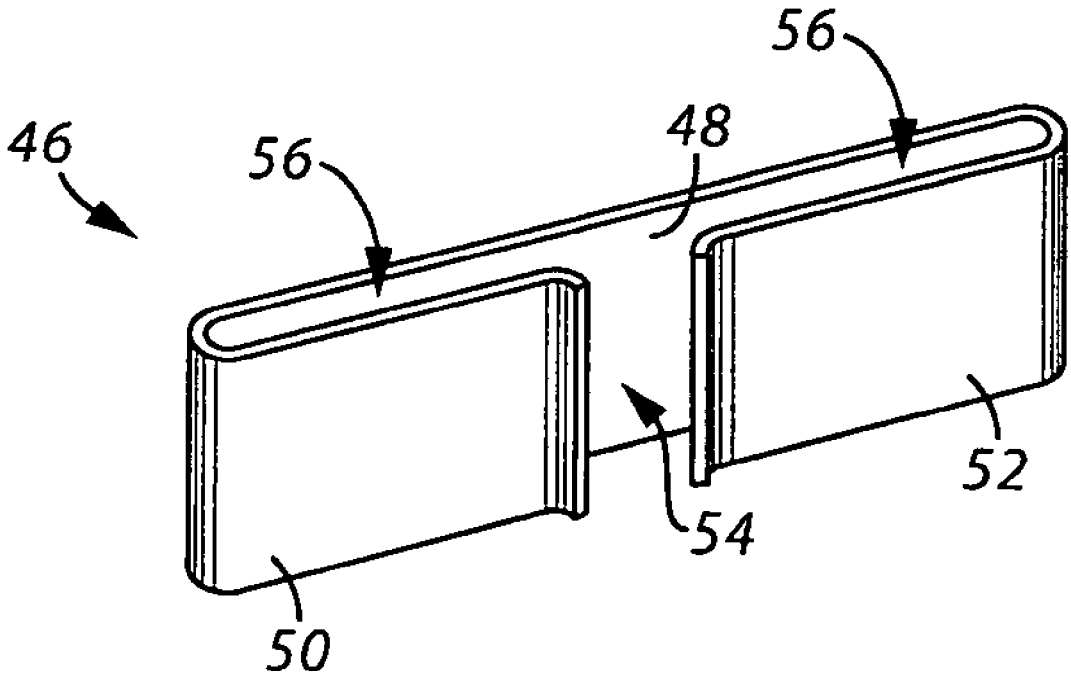
FIG. 10 is an elevated perspective view of a unitary clothing strap tensioning device in accordance with a third embodiment of the present invention.

Referring now to FIG. 10, a tensioning device is shown in accordance with a third general embodiment of the present invention. In this embodiment of the invention, the device is comprised of a semi-rigid or rigid unitary member, shown generally as reference numeral 46. The tensioning member 46 has a geometry generally defined by planar rear wall portion 48, and left and right planar front wall portions, 50 and 52, respectively, adjoined by semi-circular sidewall portions. The front wall portions 50, 52 are disposed in a common plane slightly offset from and parallel to the rear wall portion 48. The left and right front wall portions terminate at respective edges defining a strap-receiving opening 54 therebetween. The rear, front and side wall portions together define a strap retaining slot 56 sized and shaped for simultaneously retaining the pair of clothing straps in a tensioned condition while preventing twisting of the straps.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

For example, although it is preferred that the clothing strap tensioning device shown in FIGS. 3-6 has an elastic construction, it is also contemplated to utilize a non-elastic tensioning member in lieu of elastic tensioning member 22. Furthermore, although the tensioning device shown in FIGS. 3-6 is substantially restricted from vertical displacement by friction with the straps, as well as by the V-shape of the inwardly drawn straps, it is contemplated to utilize an auxiliary attachment device (not shown) to aid in securing the tensioning device to one or both of the brassiere straps. For example, the auxiliary attachment can comprise a simple hook or clasp member secured to both the tensioning device and strap(s), which structures are well known in the art.

What is claimed is:

1. A clothing strap tensioning device in combination with clothing having rear shoulder straps, comprising:

an elastic member having a limited length and a geometry generally defined by substantially coplanar middle, left end, and right end portions; and wherein the elastic member defines a boundary having upper, lower, left and right edges; and wherein the middle portion is substantially rectangular; and wherein the upper edge slopes upwardly from the middle portion of the elastic member toward the left and right end portions thereof; and wherein the lower edge slopes upwardly from the middle portion of the elastic member toward the left and right end portions thereof; and means integrated into the left end and right end portions for enabling releasable attachment of the end portions to each other to form the elastic member into a loop;

wherein each of said left and right end portions of the elastic member project upwardly and perpendicularly away from said middle portion, and wherein, upon securing the tensioning device about one or more spaced-apart rear shoulder straps, the rear shoulder straps are drawn inwardly toward each other medially in a manner preventing twisting of the rear shoulder straps.

2. The clothing strap tensioning device of claim 1, wherein the length of the middle portion is approximately equal to the combined lengths of the left and right end portions.

3. The clothing strap tensioning device of claim 1, wherein the left and right edges are substantially parallel.

4. The clothing strap tensioning device of claim 1, wherein the elastic member is attached to a slide, wherein the slide is slidable along the length of the clothing straps when the elastic member forms the loop with the left and right end portions.

5. The clothing strap tensioning device of claim 1, wherein the elastic member has an increased transverse width along corresponding segments of the left and right end portions adjacent to the middle portion.

6. A clothing strap tensioning device in combination with clothing having rear shoulder straps, comprising:

an elastic member having a limited length, a substantially rectangular middle portion;

a left end portion coplanar with the middle portion, wherein the left end portion defines a first upper edge, a first lower edge, and a left edge; and wherein the first upper and lower edges slope upwardly in the same plane from the middle portion to the left edge;

a right end portion coplanar with the middle and left end portions, wherein the right end portion defines a second upper edge, a second lower edge, and a right edge; and wherein the second upper and lower edges slope upwardly in the same plane from the middle portion to the right edge; and a releasably attachable element integrated into the left and right end portions for engaging the left and right end portions to form the elastic member into a loop; and wherein, upon securing the tensioning device about one or more spaced-apart clothing straps, the rear shoulder straps are drawn inwardly toward each other medially in a manner preventing twisting of the rear shoulder straps.

7. A method for drawing together two or more rear shoulder straps on a garment comprising the steps of:

Positioning a tensioning device about one or more rear shoulder straps on a garment, wherein the tensioning device comprises an elastic member having a limited length and a geometry generally defined by substantially coplanar middle, left end, and right end portions; and wherein the elastic member defines a boundary having upper, lower, left and right edges; and wherein the middle portion is substantially rectangular; and wherein the upper edge slopes upwardly from the middle portion of the elastic member toward the left and right end portions thereof; and wherein the lower edge slopes upwardly from the middle portion of the elastic member toward the left and right end portions thereof; and means integrated into the left end and right end portions for enabling releasable attachment of the end portions to each other to form the elastic member into a loop;

wherein each of said left and right end portions of the elastic member project upwardly and perpendicularly away from said middle portion, and wherein, upon securing the tensioning device about one or more spaced-apart rear shoulder straps, the rear shoulder straps are drawn inwardly toward each other medially in a manner preventing twisting of the rear shoulder straps; and securing the tensioning device about the rear shoulder straps.

8. The method according to claim 7, wherein the left and right edges are substantially parallel.

9. The method according to claim 7, wherein the elastic member is attached to a slide, wherein the slide is slidable along the length of the clothing straps when the elastic member forms the loop with the left and right end portions.

* * * * *